US005676068A

United States Patent [19]

Kallander

[11] Patent Number: 5,676,068

[45] Date of Patent: Oct. 14, 1997

[54] VERSATILE TABLES WHICH FORM EXPANDABLE LOOP ASSEMBLIES

[76] Inventor: Charles A. Kallander, P.O. Box 2445, Sebastopol, Calif. 95473-2445

[21] Appl. No.: 595,204

[22] Filed: Feb. 1, 1996

[51] Int. Cl.[6] ..... A47B 57/00

[52] U.S. Cl. ..... 108/64; 108/66

[58] Field of Search ..... 108/64, 65, 66, 108/69

[56] References Cited

U.S. PATENT DOCUMENTS

| | | | |
|---|---|---|---|
| 2,694,611 | 11/1954 | Lorber . | |
| 2,705,179 | 3/1955 | Hodgin . | |
| 2,871,073 | 1/1959 | Swanson . | |
| 3,002,787 | 10/1961 | Ziegenfuss | 108/64 X |
| 3,053,598 | 9/1962 | Cheslow | 108/64 |
| 3,267,881 | 8/1966 | Saggione | 108/64 X |
| 3,342,147 | 9/1967 | Shettles . | |
| 3,714,906 | 2/1973 | Finestone | 108/64 |
| 3,955,850 | 5/1976 | Toso | 108/64 |

FOREIGN PATENT DOCUMENTS

| | | | |
|---|---|---|---|
| 267794 | 1/1969 | Austria | 108/64 |
| 82329 | 11/1956 | Denmark | 108/64 |
| 1463176 | 12/1966 | France | 108/64 |
| 2300521 | 10/1976 | France | 108/64 |
| 2333331 | 1/1975 | Germany | 108/64 |
| 3610232 | 10/1987 | Germany | 108/64 |
| 1276836 | 6/1972 | United Kingdom | 108/64 |

*Primary Examiner*—Jose V. Chen
*Attorney, Agent, or Firm*—Bromberg & Sunstein LLP

[57] ABSTRACT

Tables having tops (20, 22, 23, 24, 25, 26, 28, 30, 32, 34, 36, 38) with two or more edge portions designed to be adjoining edges. One adjoining edge is concave with a radius r. A second adjoining edge is convex with a radius r, less enough clearance to prevent binding as adjacent tables nest and rotate, one in the other, to form variable-angle assemblies. Any additional non-adjoining edge, or edges, give the designer great latitude in choosing practical and aesthetic shapes. Multiple identical tables can form curved or straight, open or closed, loop assemblies. Tables in assembly can be fastened to prevent horizontal separation.

16 Claims, 12 Drawing Sheets

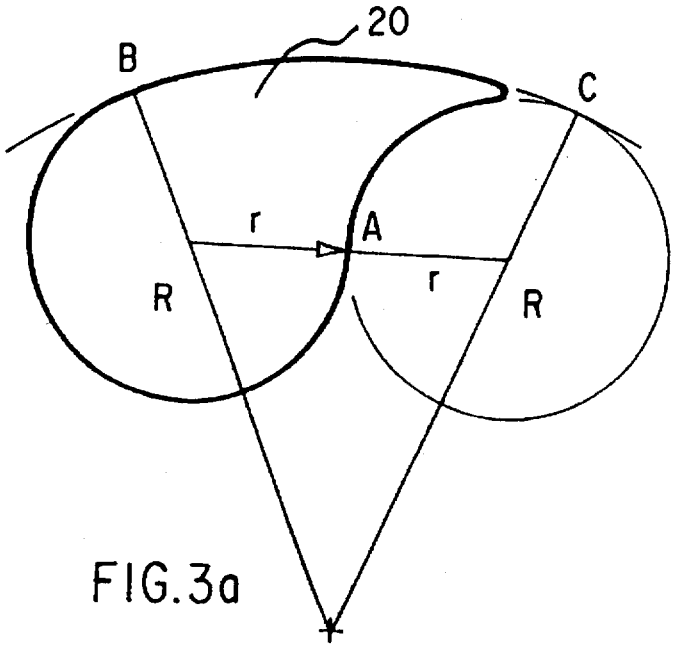
FIG.3a
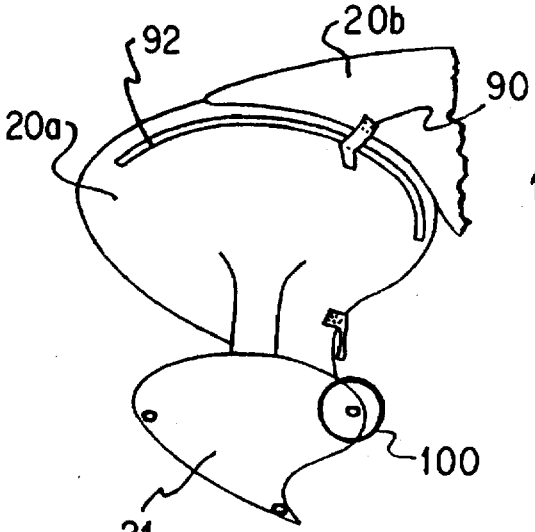
FIG.3b
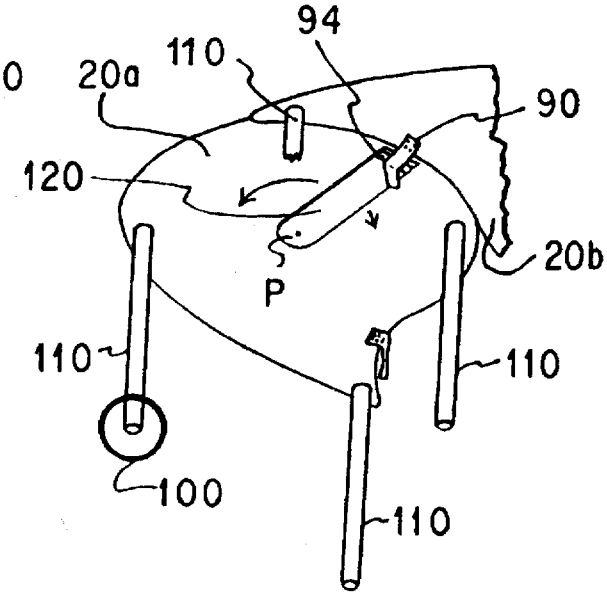
FIG.3c
FIG.3d
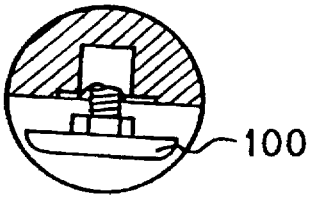

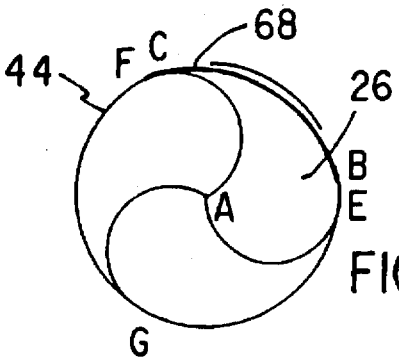
FIG.8a
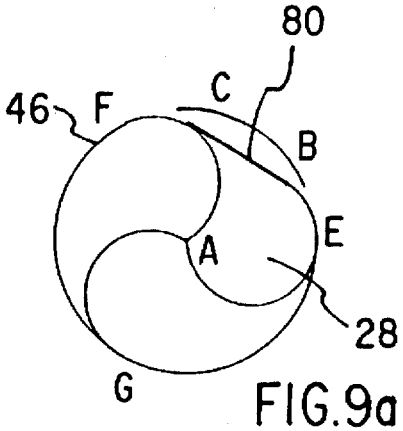
FIG.9a
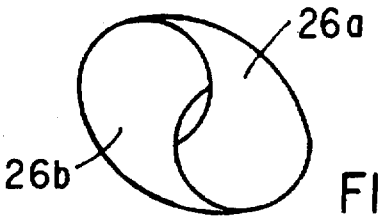
FIG.8b
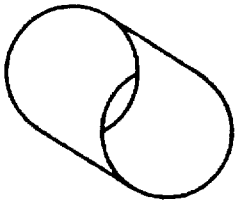
FIG.9b
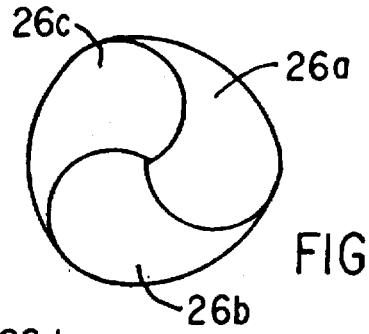
FIG.8c
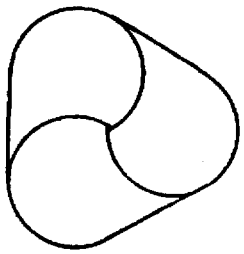
FIG.9c
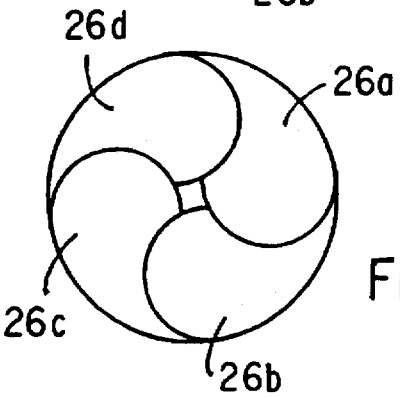
FIG.8d
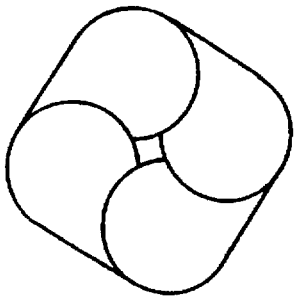
FIG.9d
FIG.9e
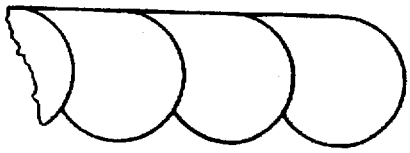

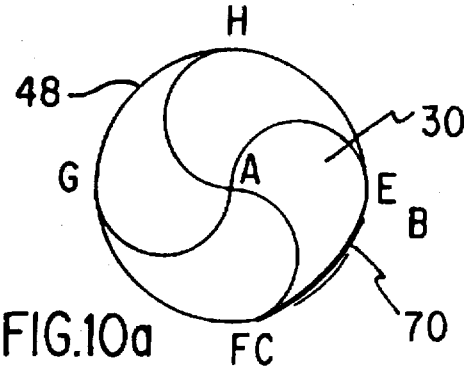
FIG.10a
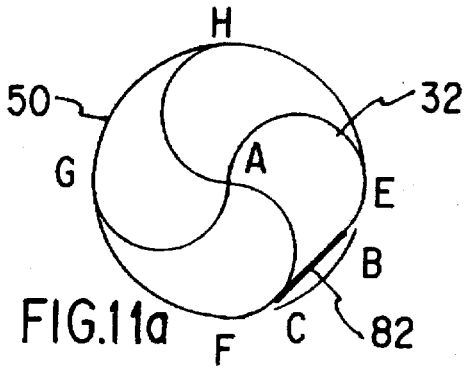
FIG.11a
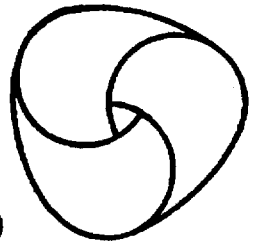
FIG.10b
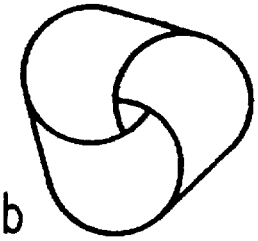
FIG.11b
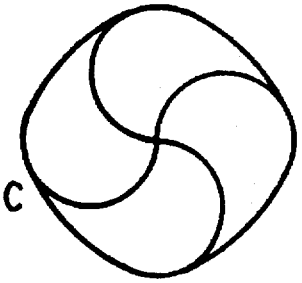
FIG.10c
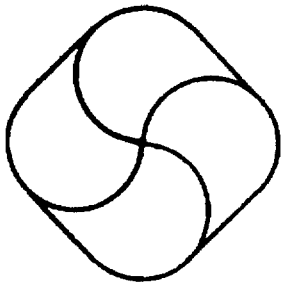
FIG.11c
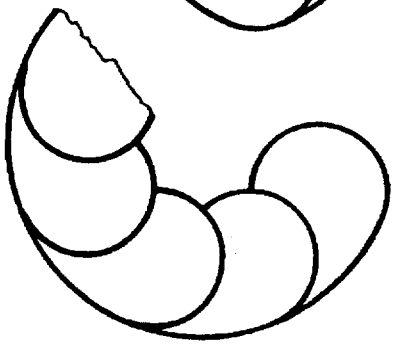
FIG.10d
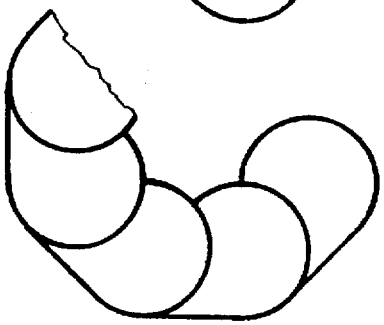
FIG.11d
FIG.11e
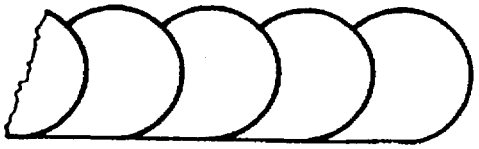

FIG.13b
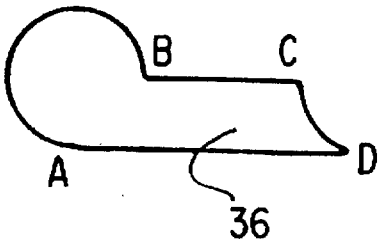
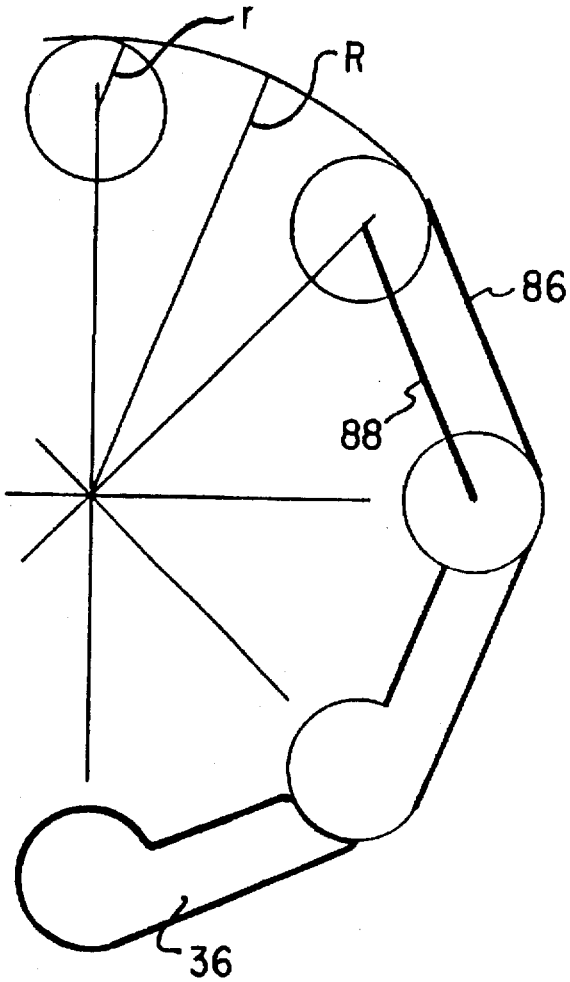
FIG.13a
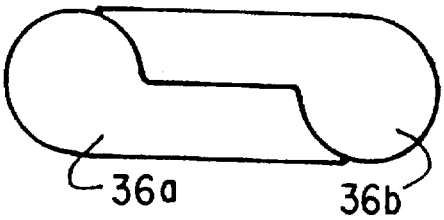
FIG.13c
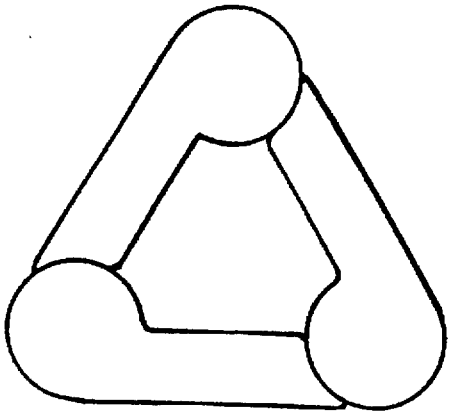
FIG.13d
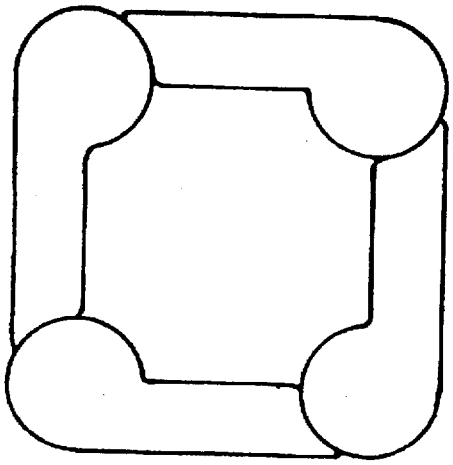
FIG.13e
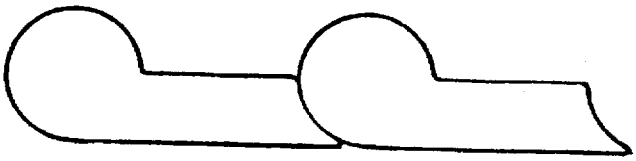
FIG.13f

VERSATILE TABLES WHICH FORM EXPANDABLE LOOP ASSEMBLIES

BACKGROUND—FIELD OF INVENTION

This invention relates to floor-standing tables, specifically to a family of variable-angle table components which can be assembled to form loops of nearly any size, open or closed, with perimeters that are curved or straight.

BACKGROUND—DISCUSSION OF PRIOR ART

Tables of many designs are used for diplomatic negotiations, labor/management negotiations, and for academic, political, and professional conferences. Typical settings are hotels, universities, TV studios, and governmental or corporate meeting rooms.

When the United Nations, or a national congress, determines that it wants a circular or a semi-circular table arrangement, a single-purpose room is designed with permanent built-in tables. However, this option is not widely chosen because it is relatively costly to build and is not adaptable to changes in group size.

Figure 1A:
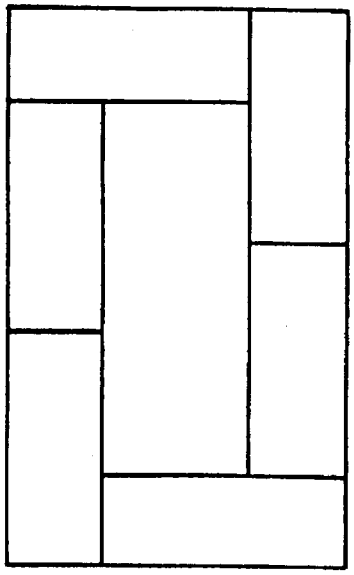
FIG.1a PRIOR ART
Figure 1B:
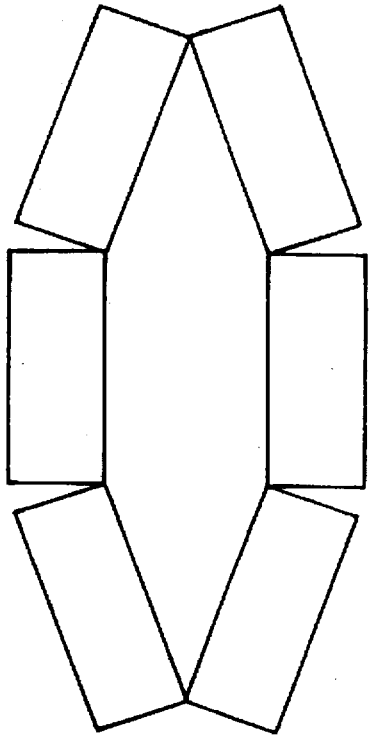
FIG.1b PRIOR ART

Another approach is to use rectangular tables and to approximate a preferred size and shape of assembly for each group. An example is shown in FIG. 1*a*. But because these tables have fixed-angle, ninety-degree corners, they naturally form rectangular assemblies. If used to approximate a curve, the assembly is marred by triangular gaps between tables, as shown in FIG. 1*b*. If a dozen people want a circle, they may have to make do with a square.

There have been a number of attempts to provide more flexible table assemblies.

Figure 1C:
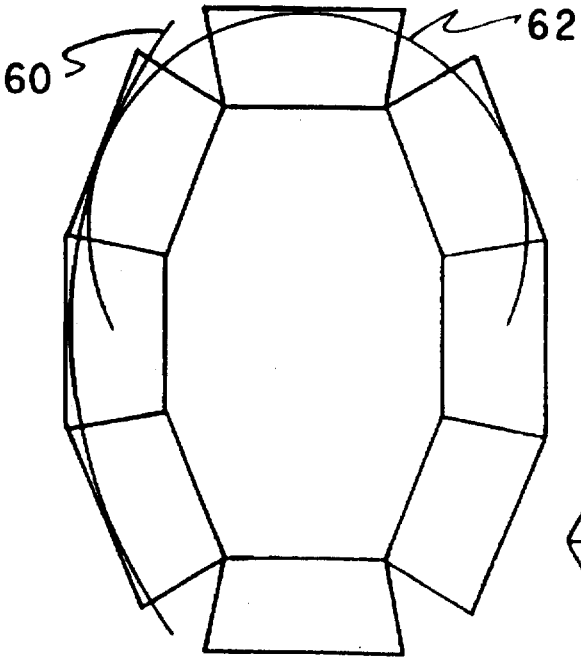
FIG.1c PRIOR ART

Trapezoidal tables are shown in U.S. Pat. No. 2,871,073 (1959) to Swanson. FIG. 1*c* of the present application shows a group of identical trapezoidal tables arranged along one predetermined arc 60. But these same tables cannot conform to smaller arcs, such as arc 62, without forming gaps in the outside perimeter.

Figure 1D:
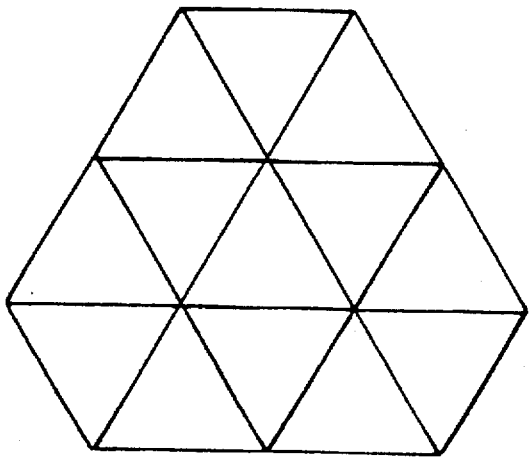
FIG.1d PRIOR ART

Equilateral-triangular tables are seen in U.S. Pat. No. 3,342,147 (1967) to Sherries. FIG. 1*d* shows a group of twelve such tables assembled around an empty center. They form a hexagon with unequal sides. Six such tables can form an equilateral hexagon (not shown), as can eighteen (not shown). But triangular tables cannot form either rectangular or circular assemblies without gaps.

Rectangles, trapezoids, and triangles all suffer from fixed-angle rigidity. A closed loop without gaps can be assembled using any one of these shapes. But adding or taking away Just one table causes gaps to appear. For this reason it is hard to match assemblies of fixed-angle tables to a particular group size, or, to an oddly shaped room.

Other designs have employed tables with arcuate adjoining edges. U.S. Pat. No. 3,714,906 (1973) to Finestone suggests five different shapes that fit around a circular table to form various assemblies. However, these different shapes are not interchangeable. It is necessary to store an inventory of five different shapes to create the various assemblies.

U.S. Pat. No. 2,705,179 (1955) to Hodgin shows a rigid link connecting a concave edge of an auxiliary table to a convex edge of either a main table or another auxiliary table. The main and auxiliary tables are not interchangeable. Each main table has four legs and can stand alone. But each auxiliary table has only two legs, and cannot stand alone. It must be indirectly supported by another table.

U.S. Pat. No. 2,694,611 (1954) to Lorber shows a display shelf with a changeable configuration. Tops in the shape of equal-radius eclipses are employed. Every sixth top is supported directly from the ground. The others are supported indirectly by connector devices which also guide their rotation. Similar full-sized tables with typical table loads need connector devices that are both precision-made and very sturdy. And assemblies of only two or three tops would be unstable unless all receive support from the ground. U.S. Pat. No. 3,955,850 (1976) to Toso shows a cushion in the shape of one particular equal-radius eclipse, but provides no guidance on table or platform construction.

All table designs for forming loop assemblies heretofore known suffer from at least one of the following disadvantages:

(a) They are permanent, built-in fixtures, with no provision for expansion or contraction.

(b) They employ fixed-angle tables which develop gaps in the outside perimeter when they are arranged to form circular assemblies.

(c) They do not adapt well to confining spaces.

(d) They require several different table shapes to provide a loop assembly.

(e) They employ rigid and expensive connecting links between the tables in an assembly.

(f) They employ indirectly-supported auxiliary tables which, in small assemblies, are unbalanced.

OBJECTS AND ADVANTAGES

Accordingly, several objects and advantages of this invention are:

(a) to provide movable table assemblies which can expand and contract;

(b) to provide an expanding series of table assemblies which closely approximate circles without having triangular gaps develop in the outside perimeter;

(c) to provide table assemblies that adapt well to confining spaces and oddly shaped rooms;

(d) to provide a system which uses identical interchangeable tables;

(e) to provide tables which do not require rigid interconnecting links;

(f) to provide novel, stable, independent, floor-standing tables. Other objects and advantages are:

(a) to provide table assembly shapes that can uniquely approximate triangles, rectangles, pentagons, hexagons, heptagons, octagons, and so on;

(b) to provide table assemblies that have shapes which lie between circular and triangular, or between circular and rectangular, and so on;

(c) to provide highly flexible and adaptable support surfaces for workplace equipment such as computers and printers, or for a caterer's equipment and the like;

(d) to provide children's work tables and desks which create unique classroom settings that serve the goals of both education and socialization;

(e) to provide miniature tables with a wide variety of shapes to serve as display stands for sculpture, jewelry, and the like;

(f) to provide a wide array of coffee-table designs;

(g) to provide tables which provide symbolic value, in this case a meaningful connection between the Yin/Yang symbol from the East, and King Arthur's round table from the West.

Further objects and advantages will become apparent from a consideration of the ensuing description and drawings.

DRAWING FIGURES

FIGS. 1*a* to 1*d* show plan views of fixed-angle, prior-art table tops.

Figure 2A:
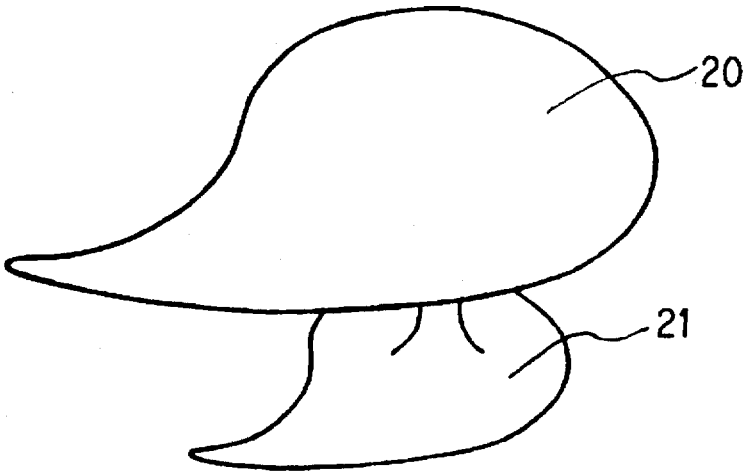
Figure 2B:
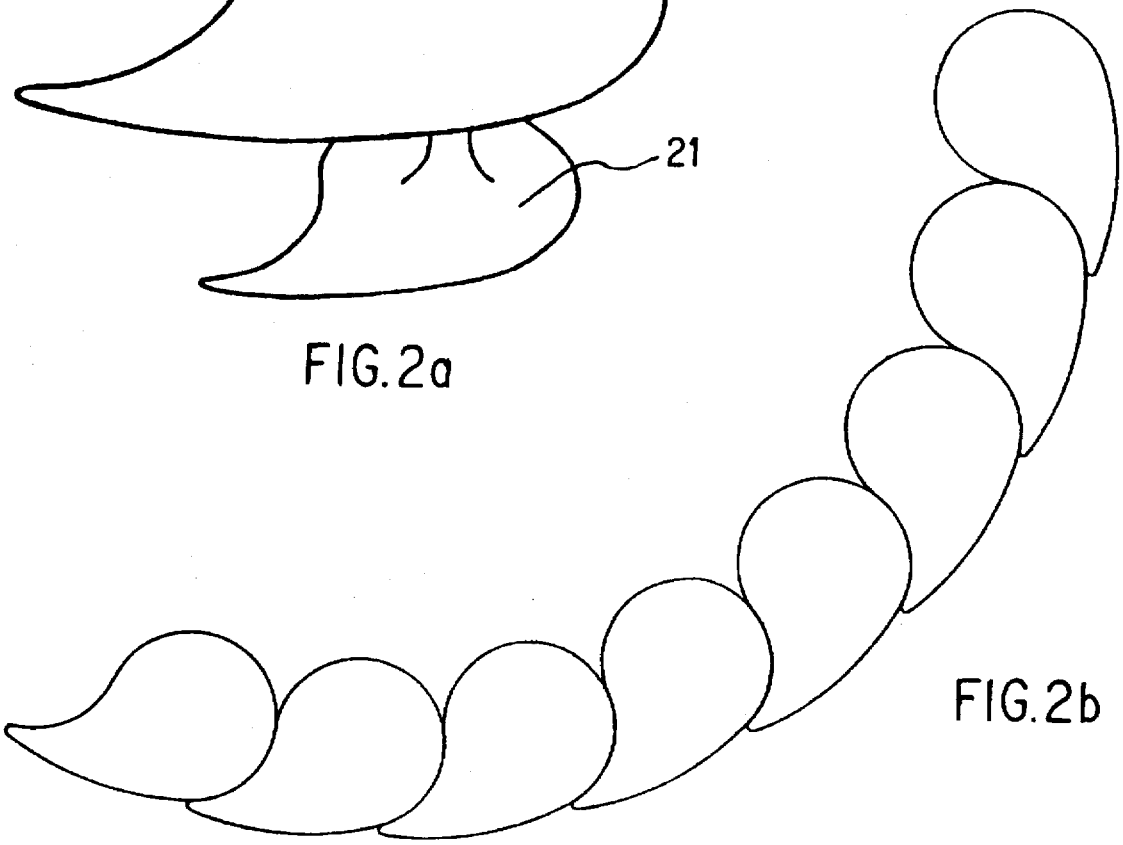
Figure 2C:
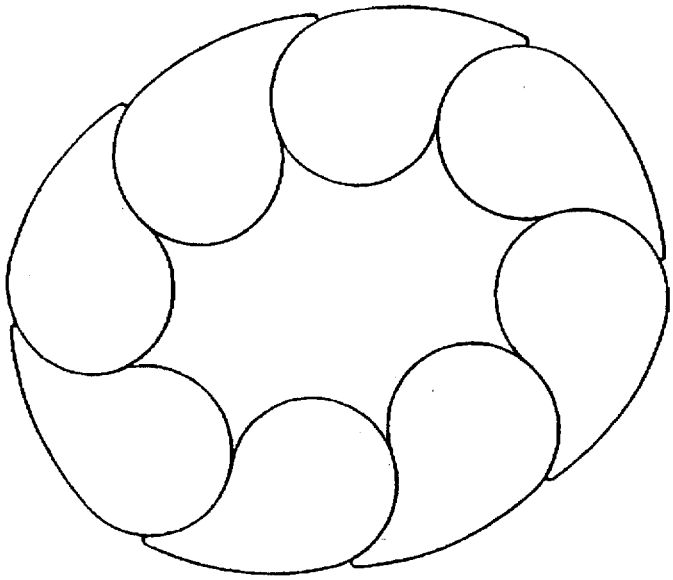

FIG. 2*a* a perspective drawing of a single, teardrop-shaped, or comet-shaped, table according to a preferred embodiment of the invention. FIGS. 2*b* and 2*c* are plan views of assemblies of tables with tops as in FIG. 2*a*.

FIG. 3*a* is detailed plan view of the table top of FIG. 2*a*. FIG. 3*b* is a perspective drawing, from below ground level, looking at the undersides of a whole table and the tail portion of a second table, as in FIG. 2*a*. FIG. 3*c* is a similar perspective view of similar Sops as in FIG. 3*b*, but with leg supports and no pedestal support. FIG. 3*d* is a detail of glide 100.

FIGS. 4*a* to 4*d* are plan views showing the changing angular relationship between two identical table tops as in FIG. 2*a*, as more such tops are added to an assembly.

Figure 5A:
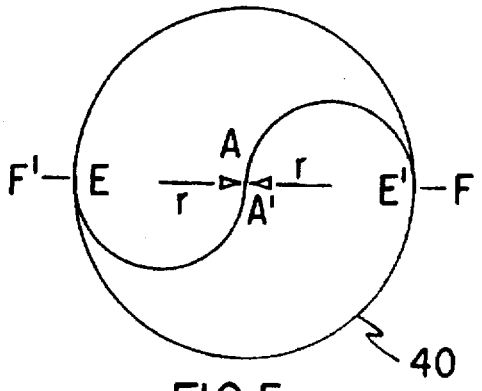

FIG. 5*a* the outline of the Yin/Yang symbol, a circle which is cut in half by two arcs. FIGS. 5*b* to 5*g* show how to trim the tails on the shapes in FIG. 5*a* so as to create the table top of FIG. 2*a*.

Figure 6A:
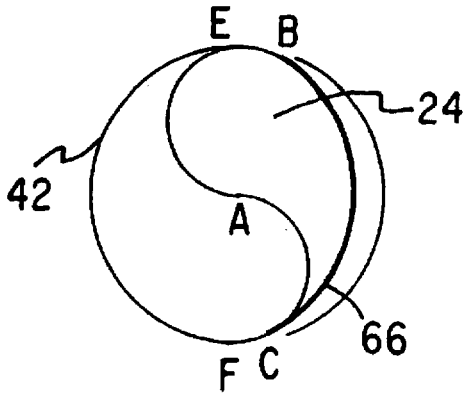
Figure 6B:
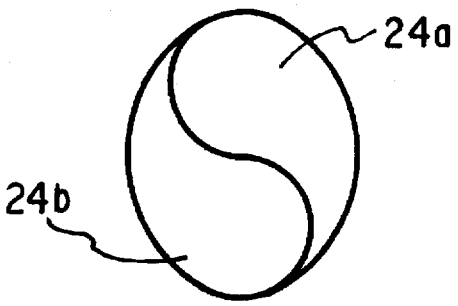
Figure 6C:
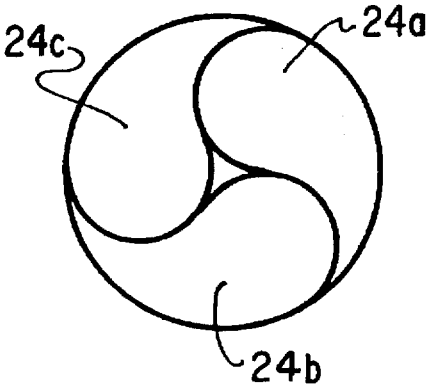

FIGS. 6*a* to 6*c* show second embodiment, a table top that also is cut from the outline of the Yin/Yang symbol as was the table top in FIG. 2*a*.

Figure 7A:
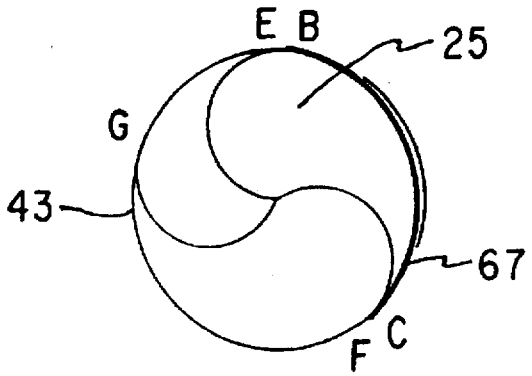
Figure 7B:
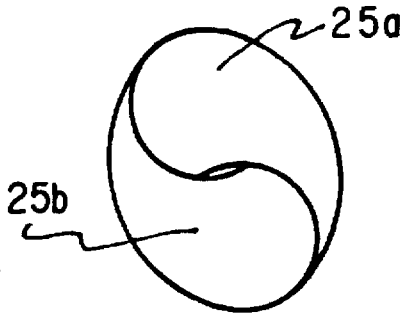
Figure 7C:
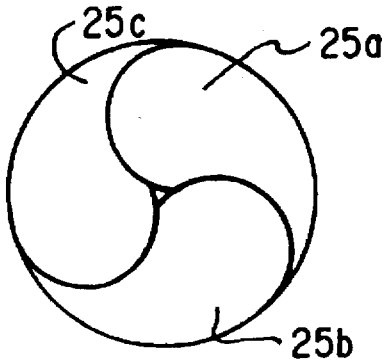

FIGS. 7*a* to 7*c* show a third embodiment, a table top that is cut from a circle divided by 2.5, a decimal fraction.

FIGS. 8*a* to 8*d* show a fourth embodiment, a table top cut from one-third of a circle.

FIGS. 9*a* to 9*e* show a fifth embodiment, a table top cut from one-third of a circle using a straight edge tangent to adjacent arcs.

FIGS. 10*a* to 10*d* show a sixth embodiment a table top cut from one-fourth of a circle.

FIGS. 11*a* to 11*e* show a seventh embodiment, a table top from one-fourth of a circle using a straight edge tangent to adjacent arcs.

Figure 12A:
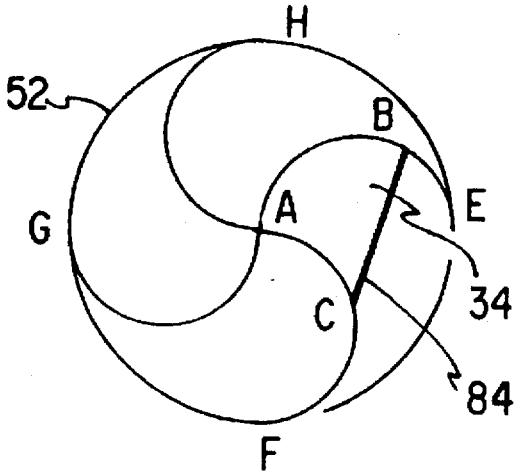
Figure 12B:
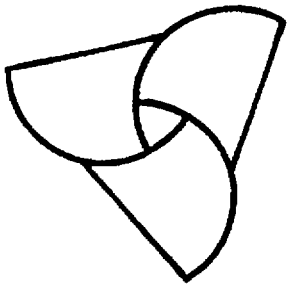
Figure 12C:
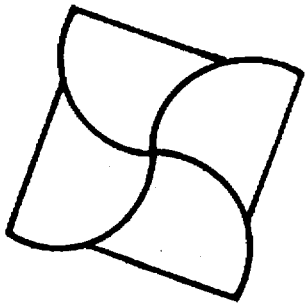
Figure 12D:
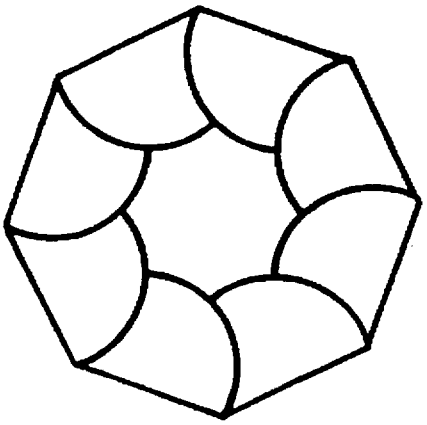

FIGS. 12*d* show an eighth embodiment, a table top cut from one-fourth of a circle using a straight line in such a way that an octagonal perimeter is formed by an eight table assembly.

FIGS. 13*a* to 13*f* show a ninth embodiment, a four-edged table top/with two adjoining edges interspersed between non-adjoining edges.

FIGS. 14*a* to 14*d* show a tenth embodiment, a two-edged table top shaped like an equal-radius eclipse.

| Reference Numerals In Drawings | |
|---|---|
| 20 top | 21 pedestal |
| 22 top | 23 top |
| 24 top | 25 top |
| 26 top | 28 top |
| 30 top | 32 top |
| 34 top | 36 top |
| 38 top | 40 circle |
| 42 circle | 43 circle |
| 44 circle | 46 circle |
| 48 circle | 50 circle |
| 52 circle | 60 arc |
| 62 arc | 64 arc |
| 66 arc | 67 arc |
| 68 arc | 70 arc |
| 80 line | 82 line |
| 84 line | 86 line |
| 88 line | 90 strap |

-continued

| Reference Numerals In Drawings | |
|---|---|
| 92 strap | 94 strap |
| 100 glide | 110 leg |
| 120 link | |

SUMMARY

Every table top in designs of the invention has two edges which are intended to be adjoining edges. One adjoining edge is concave with radius r. The other adjoining edge is convex with radius r, less a small clearance to allow for non-binding rotation between table tops. Other edges, which can be adjoining edges or not, may be added to create different designs. The shape and length of these edges can vary widely, giving the designer many options.

If two identical table tops are juxtaposed such that the concave adjoining edge of the first partly surrounds the convex adjoining edge of the second, each table can rotate in a horizontal plane relative to the other. The rotation is always about the common center of the two engaged adjoining edges. Thus every pair of adjacent tables has a variable-angle capacity, making them versatile. They are readily reconfigured to form part of either a larger or a smaller assembly.

Sets of identical floor-standing tables of the invention can form doughnut-shaped loops. And, these loops can be expanded or contracted in one table increments without having triangular gaps form on the outside perimeter.

Each table will have three or more points of contact with the ground. Three points can form a broad triangle of support that does not teeter. Height-adjustable three-point contact can be provided to guarantee a level top on uneven floors.

Description—FIGS. 2 to 4—Preferred Embodiment

FIG. 2*a* is a perspective drawing showing a single table standing alone. It has a top 20 that is shaped like a curved teardrop. The top is supported by a pedestal 21.

At ground level, pedestal 21 is also shaped like a curved teardrop. It is sized to allow chairs to extend under the table. Pedestal 21 is appropriately weighted to add stability to the table.

The upright portion of the pedestal is firmly attached to the underside of the top.

FIGS. 2*b* and 2*c* are plan views showing two possible assemblies of identical tables as in FIG. 2*a*.

FIG. 2*b* shows eight tables assembled to form an arc that represents one-third of a full circle.

FIG. 2*c* shows eight tables assembled in an oblong shape.

FIG. 3*a* is a plan view of table top 20. The top has three edges; AC, AB, and BC. These edges are arcs from each of three circles.

Edge AC is a concave arc from a circle of radius r. It is the concave adjoining edge, and forms one side of the tail of the top.

Edge AB is a convex arc from a second circle, also of radius r. It is the convex adjoining edge, and forms the head end of the top.

Edge BC is a convex arc from a circle of radius R which just encloses a ring of eight circles (only two of which are shown) of radius r. Edge BC is a non-adjoining edge, and forms the opposite side of the tail of the top. For this design, R equals 3.613r.

The circle of edge AB and the circle of edge AC are tangent at point A. Edges AB and AC intersect at point A.

The circle of edge AB and the circle of edge BC are tangent at point B, and intersect at point B.

The circle of edge AC and the circle of edge BC are tangent, and intersect, at C. Having a sharp point that extends all the way to C is not practical, or safe. So for this and other reasons to be discussed, top 20 is rounded off as shown.

Convex edge AB and concave edge AC, each with radius r, are the adjoining edges designed to mate with identical tables.

Table top 20 can be viewed as having a head and a tail. It is oriented so that if rotated head first it would move in a counter clockwise (COW) direction. Thus it can be said to be CCW oriented. However, a clockwise (CW) orientation, or mirror image, is equally possible and desirable for each of these designs.

As tables are added one at a time up to eight, the outside perimeter can become increasingly circular. More tables may be added one at a time for a maximum of 24 tables using this design. FIG. 2*b* shows one-third of such an assembly. The outer perimeter becomes slightly scalloped as the number of tables approaches 24.

One conference-room version of this table is made of traditional hardwood. Radius r is 76.2 centimeters, or 30 inches. An assembled pair of such tables can serve 12 people. An assembly of 24 such tables can serve 64 people.

A relatively small patio version, made of a plastic material, has a radius r of 30 centimeters, or 12 inches. A pair of such tables can serve 4 people. And an assembly of 24 tables can serve 24 people.

Heavy conference-room tables need not be fastened to one another. But some lighter versions will benefit if the tables are attached by a flexible strap with a hook-and-loop fastener. Such a fastener will hold two table tops together near the center of contact between their adjoining edges.

FIG. 3*b* is a perspective drawing, from below ground level, looking at the underside of a table top 20*a* and a portion of the tail of an identical table top 20*b* which is juxtaposed to top 20*a*.

In FIG. 3*b*, one end of a hook-and-loop fastener strap 90 is permanently attached at a point near the center of the concave edge of top 20*b*. Strap 90 is stretched across the adjoining edges and is releasably attached to a hook-and-loop fastener strap 92. Strap 92 is a fixed arcuate fastener, permanently attached along the convex adjoining edge on the underside of top 20*a*. If strap 90 is released from strap 92, top 20*b* can be rotated in a range of positions relative to top 20*a* and then re-attached.

In FIG. 3*b*, the underside of pedestal 21 has a height-adjustable, screw-on glide 100, in three places. Because three points determine a plane, table top 20*a* can be leveled, and its height adjusted, over the range of the three glides 100.

FIG. 3*c* shows another top 20*a* and a tail portion of an identical top 20*b*. Each of these tops is supported by a leg 110, in three places. Each leg 110 has a screw-on glide 100 at the bottom, for leveling and height adjustment.

The circled sections in FIGS. 3*b* and 3*c* are expanded in FIG. 3*d* to show a side view of screw-on glide 100.

In FIG. 3*c*, one end of strap 90 is permanently attached to top 20*b* as in FIG. 3*b*. A link 120, made of a strip of thin material, is pivotally attached to the underside of top 20*a* at point P, the center of the circle of the convex adjoining edge. A hook-and-loop fastener strap 94 is permanently attached to link 120 to create a pivotted-link fastener. Strap 90 is stretched across the two adjoining edges and is releasably attached to strap 94. This allows top 20*b* to rotate about top 20*a* without separating.

Description—FIG. 4—Angular Relationships Of Adjacent Tables

FIGS. 4*a* to 4*d* are a series of plan views showing the angular relationships between the first two tables as other tables are added to the assembly. It also shows how the radius of the non-adjoining edge is chosen for the preferred embodiment.

Figure 4A:
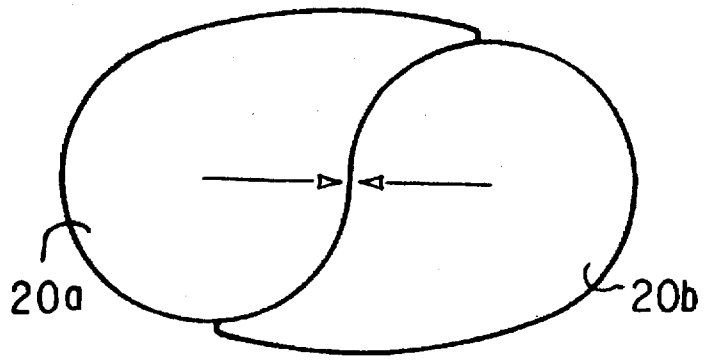

In FIG. 4*a* a first top 20*a* is assembled with an identical top 20*b* to form an oblong. The reference arrow on each top starts at the center of the circle of the convex adjoining edge, and is directed at the intersection with the concave adjoining edge. This is point A in FIG. 3*a*.

Note that in FIG. 4*a*, the arrows on table tops 20*a* and 20*b* point in opposite directions, 180 degrees apart.

For any assembly that is symmetrical about the center, dividing 360 degrees by the number of table boundaries that are crossed in tracing a loop around the center gives the step-wise change in table orientation experienced at each boundary.

If the reader will trace a closed loop around the center of FIG. 4*a*, it can be seen that each time a table boundary is crossed, a 180 degree change in table orientation is experienced. Starting at any point on top 20*a* and moving onto top 20*b* results in a 180-degree change in table orientation. Continuing around to the starting point on top 20*a* results in another 180-degree change in table orientation. The sum of the two 180-degree angles is 360 degrees, or a complete circle or revolution.

Figure 4B:
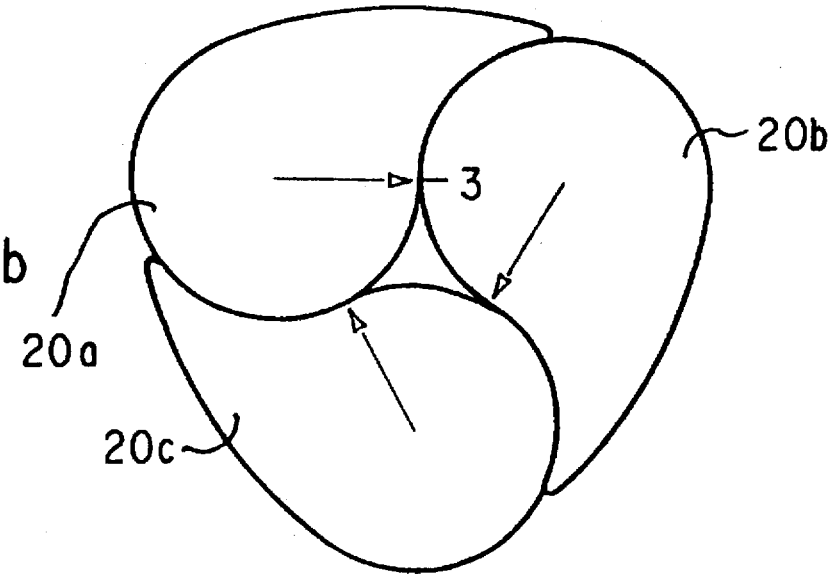

In FIG. 4*b* three tables are assembled to form a rounded triangle. Top 20*a* has the same relative position as in FIG. 4*a*. But top 20*b* is rotated to provide space for a third top, 20*c*. When tracing a closed loop around the center of this assembly, three boundaries are crossed. Since 360 degrees /3=120 degrees, there is a 120-degree change in table orientation at each boundary.

Top 20*a* has the same relative position in all of FIGS. 4*a* to 4*d* to provide a fixed reference. In FIG. 4*a*, top 20*b* is 180 degrees from top 20*a*. In FIG. 4*b*, top 20*b* is 120 degrees from top 20*a*. This is a difference of 60 degrees. In FIG. 4*b*, top 20*b* has been rotated 60 degrees CCW in order to expand the assembly to include a third table. This is called the expansion angle. So 60 degrees from the arrow on top 20*b* there is a permanent three-table mark. When that mark meets the arrow on table top 20*a*, there is room for a third table in the assembly.

Figure 4C:
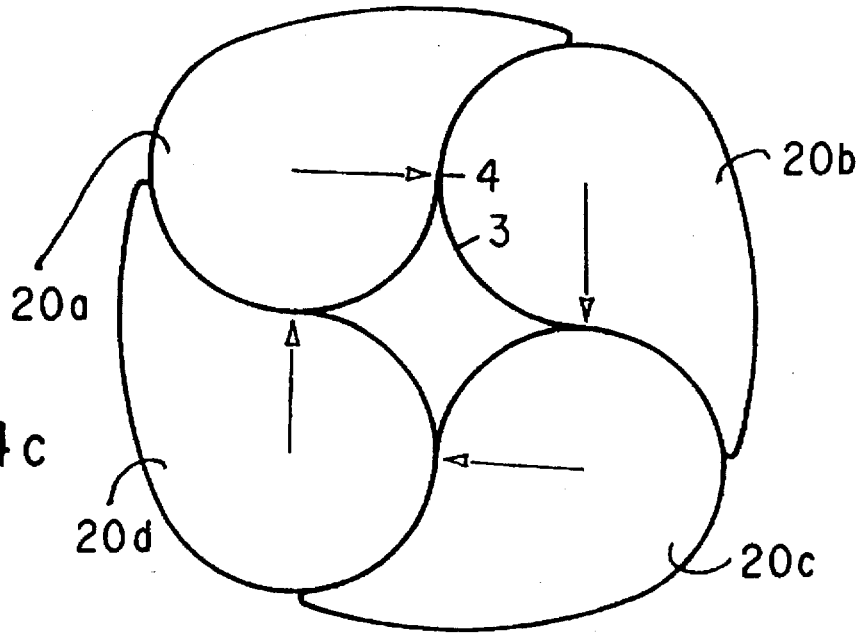

In tracing the perimeter of the four table assembly in FIG. 4*c*, four boundaries are crossed. Since 360 degrees /4=90, top 20*b* is now oriented 90 degrees from top 20*a*. Top 20*h* has been rotated 30 degrees, in addition to the previous 60 degrees, for a cumulative 90-degree expansion angle. So 90 degrees from the arrow on top 20*b* is a permanent four-table mark, in addition to the three-table mark. When the four-table mark on top 20*b* meets the arrow on top 20*a*, there is room for four tables in the assembly. Tops 20*c* and 20*d* are also oriented 90 degrees from adjacent tables.

Returning to the assembly of two tables in FIG. 4*a*, the difference in orientation of top 20*b* from top 20*a* is 180 degrees. As each table is added in subsequent Figs, this 180-degree difference in table orientation is reduced by the growing expansion angle, which is tabulated as follows:

TABLE ONE

Expansion Angle As Tables Are Added.

| Col. 1 Number of tables in assembly | Col. 2 360 degrees divided by Column 1 | Col. 3 Original 180 degree diff. in orientation less Column 2 equals the Expansion Angle |
|---|---|---|
| 2 | 180 deg. | 0 deg. |
| 3 | 120 deg. | 60 deg. |
| 4 | 90 deg. | 90 deg. |
| 5 | 72 deg. | 108 deg. |
| 6 | 60 deg. | 120 deg. |
| 7 | 51.4 deg. | 128.6 deg. |
| 8 | 45 deg. | 135 deg. |
| . | . | . |
| . | . | . |
| . | . | . |
| 12 | 30 deg. | 150 deg. |
| . | . | . |
| . | . | . |
| . | . | . |
| 24 | 15 deg. | 165 deg. |
| . | . | . |
| . | . | . |
| . | . | . |
| infinite | 0 deg. | 180 deg. |

Figure 4D:
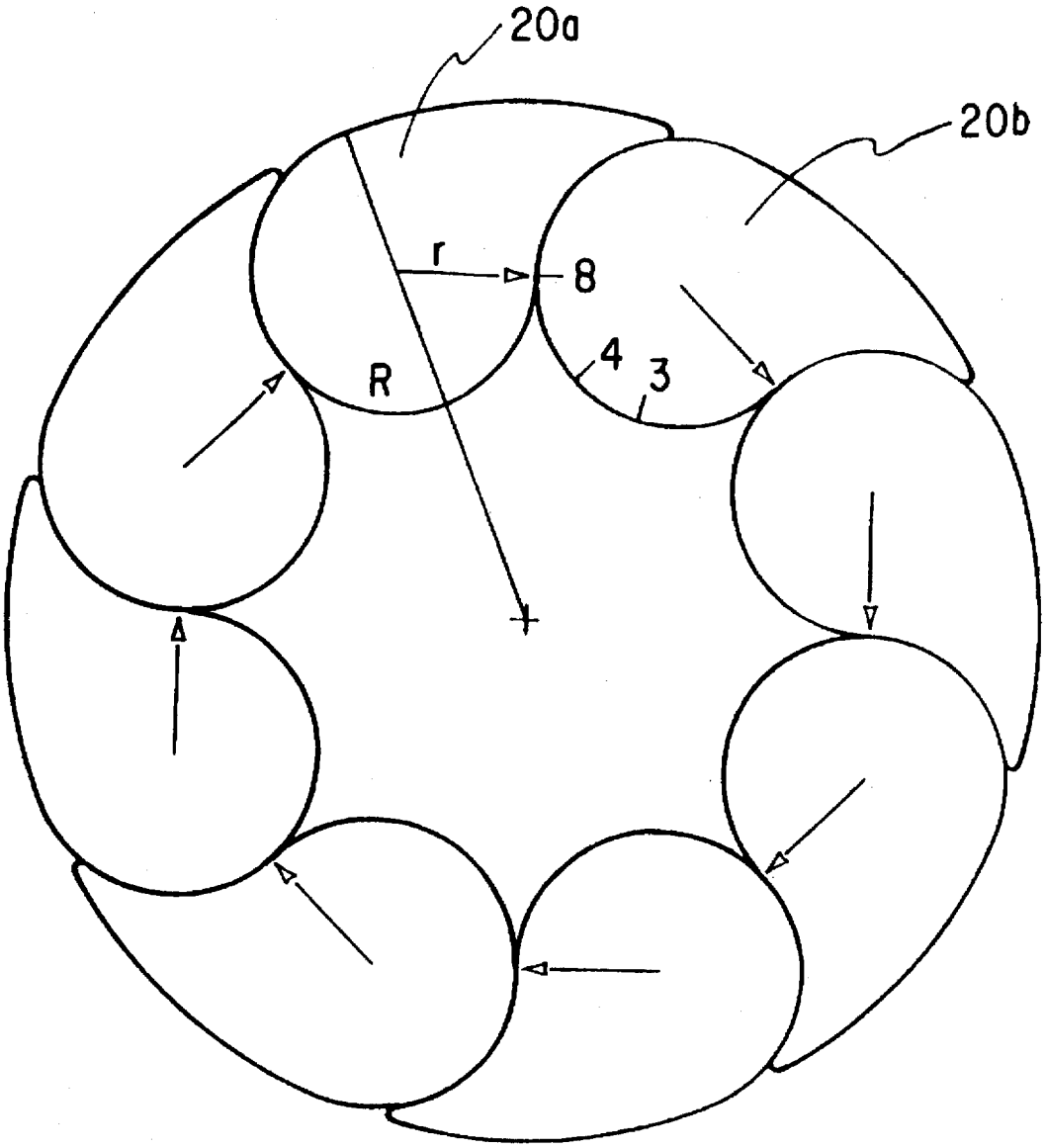

FIG. 4*d* shows eight identical tables in a perfect-circle assembly. Tops 20*a* and 20*b* are oriented 45 degrees apart, as indicated in Column 2 of Table One. Column 3 indicates an expansion angle of 135 degrees for this assembly. Top 20*b* has a permanent eight-table mark at this angle, and the three-table mark and the four-table mark are shown for comparison.

On top 20*a* in FIG. 4*d*, both radii r and R are shown. Again, r is the radius of the circle of arc AB in FIG. 3*a*, and R is the radius of a circle that will enclose a ring of eight circles of radius r. If a different radius R is chosen, a different design is generated.

Top 20 is limited to an assembly of 24 tables. Beyond that number the tops overlap one another. But other designs of the invention can expand a full 180 degrees so that all tops have the same orientation. In this position they form a straight line, which is a circle of infinite radius.

Description—FIG. 5—From Yin/Yang To Preferred Embodiment

FIG. 5 is a series of plan views showing the design process leading to a preferred embodiment, top 20, as seen in FIG. 4*d*.

Note that in FIG. 5*a* the points of tangency, where edges begin and end, are marked by letters A, E, F, A', E', and F'.

FIG. 5*a* shows a circle 40 divided by two arcs, AE and A'E'. The two identical portions of circle 40 are AEFA and A'E'F'A'. The radius r of arcs AE and A'E' equals one-half the radius of circle 40. Points A and A' are coincident, as are points F' and E, and, points E' and F.

The circles of arcs AE and A'E' are tangent at A, the center of circle 40. This is the bare outline of the familiar Chinese Yin/Yang symbol.

Figure 5E:
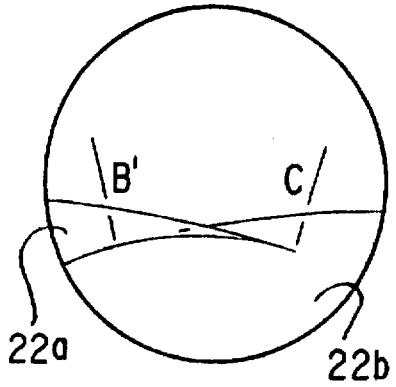
Figure 5B:
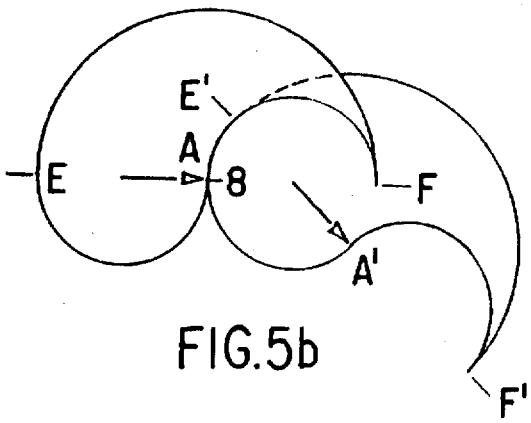

FIG. 5*b* shows AEFA in the same position as in FIG. 5*a*, but A'E'F'A' is rotated 135 degrees CCW in relation to AEFA. This is the expansion angle for an eight-table circular assembly. See Table One. The eight-table mark on A'E'F'A' meets the arrow at A on AEFA. Top 20 is designed to form a perfect-circle perimeter at this expansion angle. Note that there is interference, or overlap, between AEFA and A'E'F'A'. The tail of AEFA at F overlaps A'E'F'A'. So the outside perimeters of AEFA, and of A'E'F'D', need to be modified.

Figure 5F:
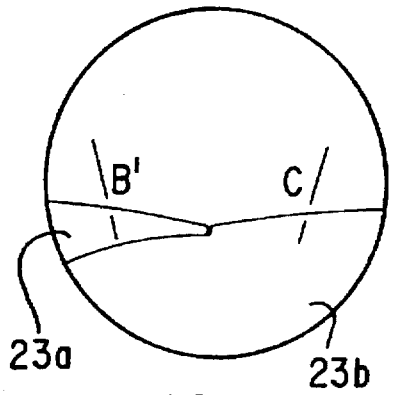
Figure 5C:
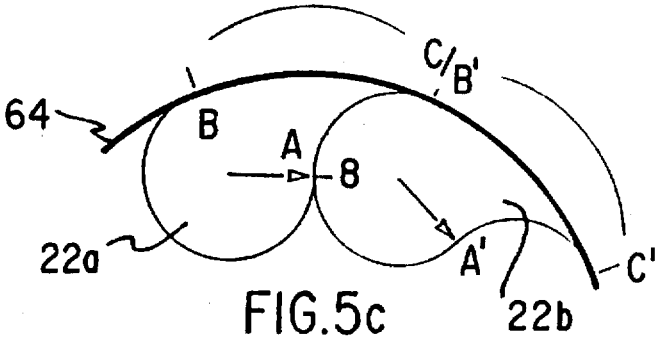

In FIG. 5*c* a bold arc 64 cuts across the figure. Bold arc 64 is an arc of radius E, not shown, which is the radius of a circle that just encloses a ring of eight circles, each having a radius r. FIG. 4*d* shows R and a ring of eight tops 20 which are based on circles of radius r.

In FIG. 5*c* bold arc 64 is placed tangent to the circle of arc AB which is an extension of arc AE in FIG. 5*b*. Arc 64 is also tangent to the circle of arc A'B' which is an extension of arc A'E' in FIG. 5*b*. Arc 64 displaces arcs EF and E'F'0 in FIG. 5*b*, and replaces them with arcs BC and B'C' in FIG. 5*c*. Points A and A' are in the same positions in both FIGS. 5*b* and 5*c*. Bold arc 64 completes the outline of tops 22*a* and 22*b*.

Note that in FIG. 5*c*, point C on top 22*a* is coincident with point B' on top 22*b*. And, there is no overlap between ABCA and A'B'C'A', but neither is there space for further expansion.

In FIG. 5*c*, the shape of top 22*a*, and of identical top 22*b*, is the preferred form, but suppose one wishes to be able to expand this assembly to 24 tables.

Figure 5D:
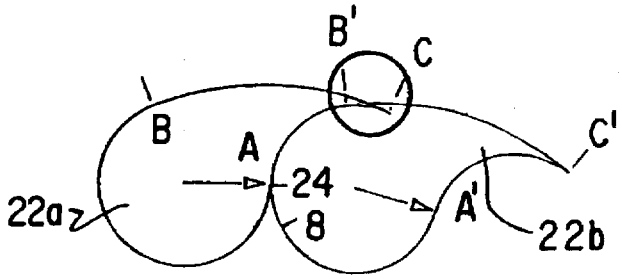

In FIG. 5*d*, the drawing of top 22*b* has been rotated to an expansion angle of 165 degrees which matches a twenty-four-table assembly in Table One. The twenty-four-table mark on top 22*b* meets the arrow at A on top 22*a*. The eight-table mark is shown for comparison. Again there is interference or overlap. This drawing of the tail of top 22*a* overlaps the drawing of top 22*b* at point C. So the appropriate blunting, or rounding off, of the point at C is raised.

For safety reasons, all sharp points are rounded off. But a second reason to round off the tail is to increase the possible expansion angle and to prevent overlap or interference.

The greatest expansion angle between a pair of identical tables is determined by measuring the relative lengths of the adjoining edges, arcs AB and AC. The length of arc AB less the length of arc AC—each measurement in degrees or radians—is the maximum expansion angle. So top 22*a* in FIG. 5*d* is poised to have the point at C rounded off enough to allow an expansion angle for up to twenty-four tables and no more.

Note that points C and B' are not coincident in FIG. 5*d*.

The circled section in FIG. 5*d* is expanded in FIG. 5*e* to show points B' and C, and, the overlap at C. In FIG. 5*f*, an alternative resolution of the overlap is shown with portions of tops 23*a* and 23*b*. Top 23*a* is in the same position as top 22*a* in FIG. 5*e*, but it is rounded off approximately halfway from C to B'. The remainder of the overlap is prevented by cutting a recess in the edge of top 23*b* to receive the tail of top 23*a*. For some designs this is an appropriate resolution.

Figure 5G:
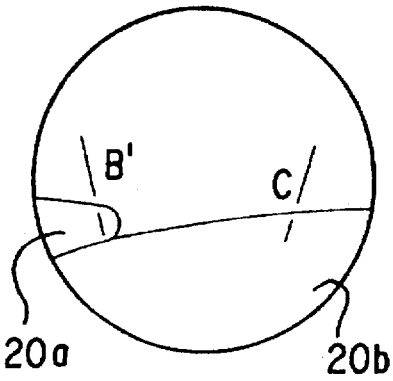

FIG. 5*g* shows the preferred resolution. The tail of top 20*a* is shown. It the same as top 22*a* in FIG. 5*e* except that it is rounded off from C all the way to B', so that top 20*a* entirely clears top 20*b*. In other words, all of the overlap is removed from the point at C on top 20*a*. This is the preferred embodiment.

Operation—FIGS. 2 to 5—Preferred Embodiment

The tables of the invention can form a wide array of assemblies, but the assembly procedure is quite simple in all cases. For example, an eight-table circular assembly is started by locating and orienting a top 20*a* as shown in FIG. 4*d*.

A second identical top 20*b* is positioned adjacent to top 20*a* with its eight-table mark opposite the arrow on top 20*a*. Hook-and-loop straps are fastened if provided. This is an expansion angle of 135 degrees. See Table One. Adding six more tables in a similar manner will complete the circle. The last two tables are maneuvered into position simultaneously.

FIG. 6—Contrasting Yin/Yang Modification

Top 24 is defined and demonstrated in FIGS. 6*a* to 6*c*. It has a longer, more elegant shape than top 20, but assemblies of tops 20 can include more tables.

FIG. 6*a* shows a circle 42 divided in half by identical arcs AE and AF.

A bold arc 66 is an arc of a circle that just encloses a ring of three circles. Bold arc 66 cuts across circle 42 tangent to the circles of arcs AE and AF at points B and C. Bold arc 66 displaces a portion of circle 42 and forms the non-adjoining edge of top 24. Arcs AB an AC are the adjoining edges.

FIG. 6*b* shows tops 24*a* and 24*b* in the closed position. They form an oblong assembly.

FIG. 6*c* shows tops 24*a*, 24*b*, and 24*c*. They form an assembly with a perfect-circle perimeter. This is because bold arc 66 is part of a circle that Just encloses a ring of three circles.

If the pointed tail of top 24 is blunted as was point C in FIG. 5*g*, an assembly of four tops 24 (not shown) is possible. Excessive blunting results in unacceptable notches in the outside perimeter of a table assembly.

Top 24 is suitable for a home or a restaurant where assemblies of no more than three or four tables are desired.

Top 24 is classified as having a CCW orientation, three edges, closure with two tops, and three tops form a perfect-circle perimeter.

The operation is the same as for the preferred embodiment.

FIG. 7—Modifying 1/2.5 of Circle FIGS. 7*a* to 7*c* show a top 25 which is generated by dividing a circle into 2.5 parts and making identical table tops out of one whole number segment.

FIG. 7*a* shows a circle 43 divided into 2.5 parts by three identical arcs AE, AF, and AG.

A bold are 67 is an arc of a circle that Just encloses an assembly of three of these tops. Bold arc 67 cuts across circle 43 tangent to the circles of arcs AE and AF at points B and C. Bold arc 67 displaces a portion of circle 43 and forms the non-adjoining edge of top 25. Arcs AB and AC are the adjoining edges.

FIG. 7*b* shows tops 25*a* and 25*b* oriented 180 degrees apart. They form an oblong shape. Note that the center does not close.

FIG. 7*c* shows tops 25*a*, 25*b*, and 25*c*. They form an assembly with a perfect-circle perimeter. This is because bold arc 67 is part of a circle that Just encloses a ring of three tops 25. Note that they do not close at the center.

Top 25, or any other top created by dividing 360 degrees by a decimal fraction that is not a whole number, cannot close at the center without a fractional segment to fill the gap as seen in FIG. 7*a*.

In all other respects, tops such as top 25 are useful and attractive.

FIGS. 8 to 9—Modifying One-third of Circle

Another embodiment of the invention uses tops that begin as one-third of a circle. Such tops will close at the center with an assembly of three tables.

FIG. 8*a* shows a circle 44 divided into thirds by identical arcs AE, AF, and AG. The three arcs meet at point A, the center of circle 44.

A bold arc 68 is from a circle that Just encloses a ring of four-thirds of a circle. Bold arc 68 cuts across circle 44 tangent to the circles of arcs AE and AF at points B and C. Bold arc 68 displaces a portion of circle 44 and forms BC the non-adjoining edge of top 26. Arcs AB and AC are the adjoining edges.

FIG. 8*b* shows tops 26*a* and 26*b* oriented 180 degrees apart. They form an oblong shape. Note that the center does not close.

FIG. 8*c* shows tops 26*a*, 26*b*, and 26*c* which do close at the center because they match the geometry at the center of circle 44 in FIG. 8*a*. The shape of the outer perimeter is between a circle and a triangle.

FIG. 8*d* shows tops 26*a*, 26*b*, 26*c*, and 26*d* which have a perfect-circle perimeter. This is because bold arc 66 just encloses a ring of four-thirds of a circle.

If the pointed tail of top 26 is blunted, as was point C in FIG. 5*g*, an assembly of up to six tops 26, not shown, is possible.

Top 26 is classified as having a CW orientation, three edges, closure with three tops, and four tops form a perfect-circle perimeter.

FIG. 9*a* shows a circle 46 cut into thirds by three identical arcs, AE, AF, and AG. The bold straight line 80 trims the tail of a third of circle 46 to form top 28. Line 80 is tangent to the circles of arcs AE and AF at B and C.

FIGS. 9*b* to 9*e* show various assemblies of tops identical to top 28 in FIG. 9*a*. The shape of top 28 in FIG. 9*a* clearly differs from top 26 in FIG. 8*a*. On top 28 the convex adjoining edge AB is longer, and the concave adjoining edge AC is shorter than comparable edges on top 26. The maximum expansion angle on top 28—the convex adjoining edge less the concave adjoining edge—is increased to 180 degrees. So top 28 forms a straight-line assembly as shown in FIG. 9*e*.

Top 28 is especially desirable for conference rooms where breakfast is served to small intimate groups followed by a plenary session conducted around one large table assembly.

Top 28 has a CW orientation with three edges, and three tables close at the center. It forms a perfect-circle perimeter with an infinite number of tables.

FIGS. 10 to 12—Modifying One-fourth Of Circle

FIG. 10*a* shows a circle 48 cut into fourths by four identical arcs, AE, AF, AG, and AH. A bold arc 70 is from a circle that Just encloses a ring of eight-fourths of a circle. Bold arc 70 cuts across circle 48 tangent to the circles of arcs AE and AF at B and C. Bold arc 70 displaces a portion of circle 48 and forms BC, the non-adjoining edge of top 30. Arcs AB and AC are the adjoining edges. FIGS. 10*b* to 10*d* show various assemblies of tops identical to top 30 in FIG. 10*a*.

The assembly in FIG. 10*b* does not close at the center, but the assembly in FIG. 10*c* does close.

FIG. 10*d* shows a portion of an assembly of eight tops which has a perfect-circle perimeter because arc 70 was a part of that circle.

Top 30 is suitable for assemblies of from four to eight tables. By further blunting the tails, nine- or ten-table assemblies, not shown, can be accommodated.

Top 30 has a CCW orientation. It has three edges. An assembly of four tops closes at the center. An assembly of eight forms a perfect-circle.

FIG. 11*a* shows a circle 50 cut in fourths by four identical arcs AE, AF, AG, and AH. A bold straight line 82 cuts across circle 50 tangent to the circles of arcs AE and AF at B and C. Bold line 82 displaces a portion of circle 50 and forms BC, the non-adjoining edge of top 32. Arcs AB and AC are the adjoining edges.

FIGS. 11*a* to 11*d* are comparable to FIGS. 10*a* to 10*d*. And, FIG. 11*e* shows that this design can expand to a straight line, similar to FIG. 9*e*.

Table 32 has a CCW orientation. It has three edges. An assembly of four closes at the center. And it allows an expansion angle of 180 degrees which permits it to form a straight line.

FIG. 12*a* shows a circle 52 cut into fourths by four equal arcs, AE, AF, AG, and AH. A bold line 84 intersects arcs AE and AF at B and C, but is not tangent to these arcs. Line 84 becomes the non-adjoining edge BC of top 34. Arcs AB and AC are the adjoining edges.

FIGS. 12*b* to 12*d* show assemblies of three, four, and eight tops identical to top 34 in FIG. 12*a*. Note that the assembly perimeter in FIG. 12*d* is an octagon.

For top 34, assemblies of four, five, six, seven, and eight are most useful. An individual top 34 that is part of a coffee-table assembly can also function as an individual serving table. It can be moved out of the assembly and placed with its concave side next to the person served.

Similar tops can be designed to create assemblies with other equilateral-polygon perimeters, not shown.

FIG. 13 Tables With Four or More Edges

There are many configurations of variable-angle table tops having four edges.

FIGS. 13*a* to 13*f* show how one such configuration, a top 36, is derived and how it can be assembled.

Two tops 36 close at the center. And tops 36 may be added one at a time to create a loop as large as the space available.

A particular room, and an intended use, often dictate a set of table design variables. In FIG. 13*a*, a circular array of eight table tops, having a radius r for the adjoining edges and a radius R for the assembly, is chosen as an example.

In FIG. 13*a*, a bold line 86 is drawn tangent to two adjacent circles on the outside of the array. This becomes the outside edge AD in FIG. 13*b*, and gives top 36 a straight line capability.

Again in FIG. 13*a*, a bold line 88 is drawn from center to center between two circles. Line 88 establishes the location of the inner edge BC in FIG. 13*b*.

A CW orientation is chosen, unneeded lines are erased, sharp corners are relieved, and top 36 emerges at the bottom of FIG. 13*a*.

In FIG. 13*b*, edge AB is the convex adjoining edge. Edge CD is the concave adjoining edge. Edges AD and BC are the two interspersed non-adjoining edges.

An assembly of two identical tables, 36*a* and 36*b*, is shown to close in FIG. 13*c*.

FIGS. 13*d* and 13*e* show assemblies of three and four tops respectively.

FIG. 13*f* shows that this table can form a straight line.

Assemblies of any number of table tops 36 is possible limited only by the space available. The expansion angle goes from zero to 180 degrees.

Top 36 is most suitable for the largest conference halls and for very large assemblies. One version is 46 centimeters, or 18 inches, between sides BC and AD. The circle of arc AB has a diameter of 92 centimeters, or thirty-six inches. These circles provide additional space to hold serving dishes.

Top 36 has a CW orientation with four edges. An assembly of two tops will close. And, it forms a straight line which is a perfect circle with an infinite radius.

FIG. 14—Embodiments With Two Edges

The simplest and most versatile shapes for variable-angle table tops are equal-radius eclipses, which have only two edges.

Figure 14A:
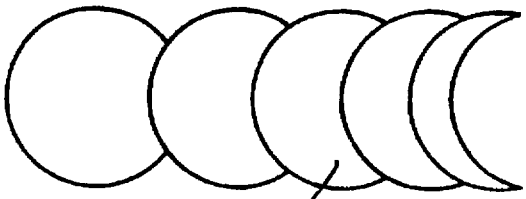

FIG. 14*a* shows several possible equal-radius eclipses all having the same radius r. They vary from a slight eclipse to nearly total eclipse. The design variables are the radius of the circles, and the distance between centers. These determine the length of both arcs, and the angle at the points where the two edges intersect.

Figure 14B:
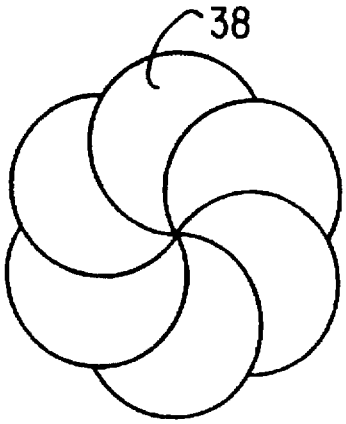

In FIG. 14*b*, top 38 was chosen as an example. An assembly of six tops 38 will close at the center of the assembly. Each top provides 60 degrees of the total 360 degrees about the center of FIG. 14*b*.

Figure 14C:
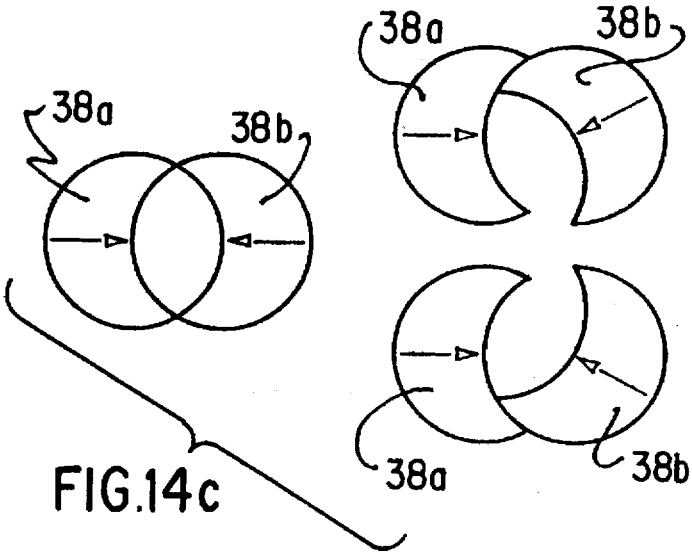
Figure 14D:
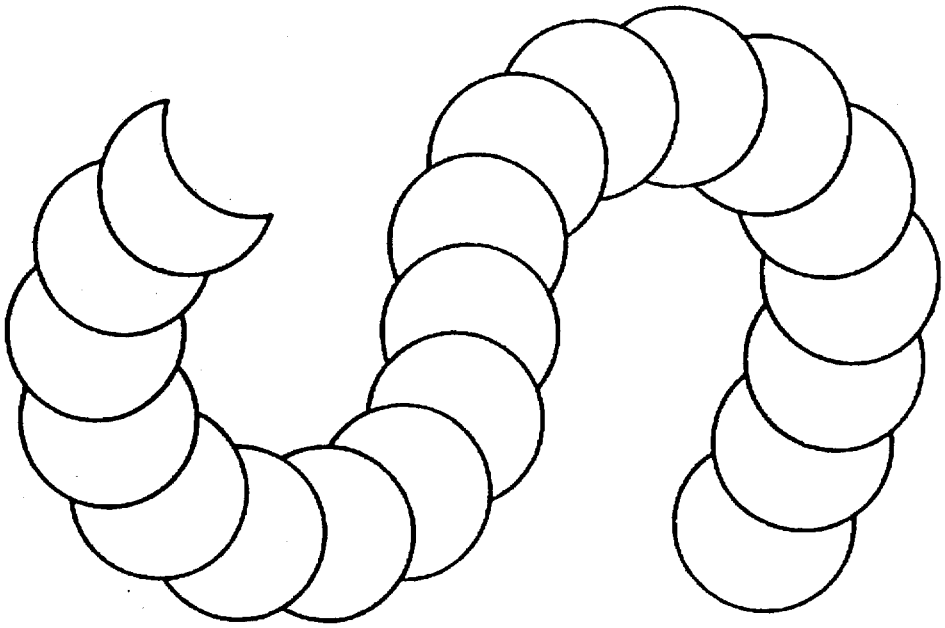

FIG. 14*c* shows two tops 38 that are initially oriented 180 degrees apart. Top 38*b* is rotated in both a CW and a CCW direction relative to top 38*a*. The expansion angle goes in either direction for this configuration. Thus tops 38 can easily form an S-curve, as seen in FIG. 14*d*.

Top 38 has both a CW and a CCW orientation. It is identical to its mirror image. It has two edges, both of which are necessarily adjoining edges. Six tops will close at the center. It cannot form a perfect-circle perimeter because it does not have a non-adjoining edge with a large radius to match an assembly perimeter.

Assemblies of tops 38 have an uneven perimeter. They are suitable for displaying products, for supporting equipment such as banks of computers, and useful for portable staging.

Classification

All of the above embodiments can be classified by the following:

(a) a CW orientation, a CCW orientation, or both, (b) the number of edges on each top, (c) the number of identical tops that create closure at the center of an assembly, and (d) the number of tops needed to create a perfect-circle perimeter.

Once a particular design is chosen, and the lengths and shapes of its edges determined, the length of the perimeter of each possible assembly can be calculated. The number of persons, or pieces of equipment, the assembly can serve follows from the length of the perimeter.

Clockwise and Counterclockwise Orientation

Variable-angle table tops which are not symmetrical about a line have a direction of orientation. This is always true of three-edged tops. The contrast in directions can be seen by comparing FIGS. 6 and 8. Tops 24 in FIG. 6 appear to be headed in a CCW direction, while tops 26 in FIG. 8 appear to be headed in a CW direction.

Variable-angle table tops with two edges, or others which are symmetrical about a line, have no such original orientation and may expand in either a CW or a CCW direction.

Identifying the Number of Edges

An edge begins and ends at a point of intersection with another edge. For conventional straight edges which meet at an acute angle, the point of intersection is easily identified. But special attention is necessary to identify the points of intersection for curved edges. When curved edges meet, the point of intersection may also be a point of tangency. The edges are parallel at that point, and so the precise intersection is not distinct. In addition, sharp points have to be blunted for safety reasons, causing some points of intersection to be further obscured. So attention is necessary to identify where curved edges meet.

Variable-angle tops all have at least two adjoining edges. They have differing numbers of non-adjoining edges.

Closure At The Center

It may be helpful to compare FIGS. 6*a*, 8*a*, and 10*a* in order to understand closure at the center. Here circles are divided into whole-number parts: 2.0, 3.0, and 4.0, respectively. The resulting shapes are distinct. A set of tables from one design can form a wide range of assemblies. However, these assemblies will close at the center only with the same number of tables as the number of divisions in the circle of origin. This applies to each of the shapes generated by cutting a circle into whole-number parts. Top 24 in FIG. 6 will only close at the center of the assembly with two tables. Top 26 in FIG. 8 will close at the center with three, and only with three tops. Two tops 26 leave a void having convex sides as seen in FIG. 8*b*. Four tops 26 leave a void having concave sides as seen in FIG. 8*d*. Top 30 in FIG. 10*c* requires four for closure.

No Closure at the Center

The number 2.5 is a decimal fraction that is not a whole number. It is not a part of the series: 2, 3, 4, 5, and so on.

As seen in FIGS. 7*a* to 7*c*, useful tables can be generated by dividing a circle—360 degrees—into 2.5 parts. Two of these parts are 144-degrees each, and a fractional part is 72-degrees. The sum of 144, plus 144, plus 72 is of course 360.

A set of identical table tops, based on the geometry of one of the 144-degree segments of a circle, can be assembled into expandable loops. However, none of these loops can close at the center. This is because no whole number of 144-degree tables add together to become 360 degrees.

The same holds true for any other decimal fraction that is not a whole number. Some examples are: 3.33, 4.8, 5.99, and 6.01.

Number of Tables for a Perfect-circle Perimeter

As shown in FIG. 4*d*, a radius R can be chosen for the convex non-adjoining edge that matches a particular assembly radius. In FIG. 8*d* table 26 forms a perfect circle with four tables. In FIG. 9*e*, tops 28 form a straight line which is a perfect-circle with an infinite radius. For a top that is an equal-radius eclipse such as top 38 in FIG. 14*b*, there is no number of tables that form a perfect-circle perimeter.

Design Variables

There are specific design variables for each classification.

The design variables for three-edged tables are the radius r of the adjoining edges, the length of each adjoining edge, and the length and shape of the non-adjoining edge. Changing the length of any edge changes the shape of the top.

The four-edged tops can have two non-adjoining edges each of which can be concave, convex, straight, or a freehand form. Adjoining edges can be interspersed between non-adjoining edges as in FIG. 13*b*. Alternatively, two or more non-adjoining edges can be placed next to each other.

Additional non-adjoining edges may be added for aesthetic or practical purposes. Tops with any number of edges are possible, but each must have a concave and a convex adjoining edge of substantially the same radius.

Use

Tables of the above designs are especially useful in conference centers. Whether for international negotiations, continuing professional education, or political debate, the adaptability and circularity of a table assembly is valued.

People seek face to face contact not only to hear and to be heard, but also to see, and to be seen. Circular arrangements optimize and equalize face to face contact. This suggests an open process, and an equal opportunity to participate.

According to legend King Arthur chose a round table to quell the rivalry among his knights. The ancient Chinese Yin/Yang symbol stands for the resolution of opposite energies in the universe. A round table assembly, made of Yin/Yang like components, suggests a unity of all points of view in a multi-polar world.

The above designs add many options for elegant dining. At a large conference center, an intimate breakfast for groups of six is served on hundreds of assembled pairs of tables. And in the evening, a banquet is served on those same tables, now arranged in concentric circles.

This same adaptation can take place on a smaller scale in a restaurant, or in a residential dining room.

The growth of computer usage creates a need for versatile tables to support new generations of equipment in old, confining spaces.

Desks, or movable work-stations in schools, can be made to mesh with other identical units. Clusters of students can arrange themselves in discussion circles, in an arc before an instructor, or in individual study modes. This not only serves the purposes of education, but creates a social environment that lends definition to both individuality and togetherness.

Platforms for painters and others who need to work overhead are made more adaptable if the above designs are used.

Staging for fashion shows and the like, can benefit from versatile platforms.

Conclusion, Ramifications, and Scope

Table assemblies from the above designs are highly versatile. Any number of tables can be assembled to match any group size, and almost any room geometry. The maximum size of a loop assembly is determined by the space available.

These identical, stand-alone tables are easy to inventory, or to redeploy. They are readily fastened to, or unfastened from, one another.

These tables can inspire togetherness in the classroom. And they offer highly adaptable supports for modern workplace equipment.

Tables have been a basic artifact throughout human history. For this reason they carry symbolic significance. If war proves to be impractical, diplomacy appropriately takes center stage. A table that is both circular and expandable, having roots in both the East and the West, may be especially meaningful.

Tables of the present patent application open a wide spectrum of beautiful new designs.

Each of these table tops has at least two adjoining edges, with essentially the same radius. But the length of that radius can vary widely, and the length of each adjoining edge can vary within the constraint of maintaining a workable expansion angle. Any number of non-adjoining edges can be added to complete the top. And the lengths and shapes of these non-adjoining edges can vary widely.

The shape of any third edge, which is generally a non-adjoining edge, can vary from convex to straight to concave. The same can be said for a fourth edge, or for additional edges.

These table tops can be supported by a single pedestal, a pedestal and leg combination, or by three or more legs. The table supports have three or more contact points with the ground. And these contact points may be glides or casters. The glides and casters may or may not be height adjustable.

These tops can be manufactured from many different materials such as wood, metal, and plastic. And they can be of any color, or of a see-through material.

The tops can he made to tilt on their pedestal. And legs can be made to fold. Such features facilitate shipping and storage. And similar staging units can he constructed.

The fasteners between adjoining table tops set a limit to radial motion between the tables. Rotary motion is restrained by the fixed arcuate fastener, and left unrestrained by the pivotted link fastener. Vertical motion is essentially unrestrained by both types of fasteners.

These fasteners can be changed in size and configuration. Various clasps can be used in place of the hook-and-loop fasteners. The fixed arcuate fastener can also be used with leg supports. And the pivotted-link fastener can be made to pivot around a pedestal post.

The pivotted-link fastener can also be pivotted on the upper face of the table top. The pivotted-link can be a thin, flat ribbon, hidden under the table cloth.

The outside perimeters of assemblies can vary widely from circular to near-circular, to oblong, to quasi-triangular, to quasi-square, and so on. Or they can form equilateral polygonal shapes.

Table assemblies may, or may not, close at the center to be useful.

The description above contains many specific examples. These should not be construed as limiting the scope of the invention. They merely provide illustrations of some of the presently preferred embodiments. Other embodiments and variations are possible. For example, it is possible for a top with a CW orientation, having six edges, closure at the center with two tops, to form an equilateral twelve-sided polygon with four identical tops.

Thus the scope of the invention should be determined by the appended claims and their legal equivalents, rather than by the examples given.

I claim:

1. A versatile platform comprising:

(a) a top providing a substantially flat surface bounded (i) by each arcuate edge portion having a first and second end, the first ends of the first and second arcuate edge portions forming a junction first and second arcuate edge portions, being convex and concave respectively, the first and second arcuate edge portions being arcs of first and second circles respectively, the first and second circles having radii of curvature that are approximately equal to a first length, third curved edge portion joining the second ends of the first and second edge portions, the a third edge portion having an average radius of curvature that is substantially greater than the first length, the third edge portion including an arc from a third circle, the arcs of the first, second and third edge portions being so disposed that the third circle and the first circle approximately touch at a point where they have parallel tangents and the third circle and the second circle approximately touch at a point where they have parallel tangents;

(b) a base for supporting the top above the ground;

so that the platform may be employed as one of a set of members similar to the platform, the members oriented so that the concave edge portion of one member mates with the convex edge portion of another adjacent member and the members collectively define a common substantially continuous peripheral edge of the set of members so oriented.

2. A platform according to claim 1, wherein the convex edge portion includes greater than 180 degrees of arc.

3. A platform according to claim 1, wherein the concave edge portion includes less than 180 degrees of arc.

4. The versatile platform of claim 3 wherein the first and second arcuate edge portions being oriented so as to form at the junction an interior angle, as determined by tangents to each of such edge portions, that is not less substantially than 90 degrees.

5. The versatile platform of claim 2 wherein the first and second arcuate edge portions being oriented so as to form at the junction an interior angle, as determined by tangents to each of such edge portions, that is not less substantially than 90 degrees.

6. A platform according to claim 5, wherein the interior angle is approximately 180 degrees.

7. The versatile platform of claim 1 wherein the first and second arcuate edge portions being oriented so as to form at the junction an interior angle, as determined by tangents to each of such edge portions, that is not less substantially than 90 degrees.

8. A platform according to claim 2, wherein the concave edge portion includes less than 180 degrees of arc.

9. A platform according to claim 1, wherein the concave edge portion includes less than 180 degrees of arc.

10. The versatile platform of claim 9 wherein the first and second arcuate edge portions being oriented so as to form at the junction an interior angle, as determined by tangents to each of such edge portions, that is not less substantially than 90 degrees.

11. A platform according to claim 10, wherein the interior angle is approximately 180 degrees.

12. The versatile platform of claim 1 wherein the platform may be employed as one of a set of at least three members similar to the platform, the members oriented so that the concave edge portion of one member mates with the convex edge portion of another adjacent member and the third edge portions of the members collectively define a common substantially continuous edge of the set of members so oriented.

13. The versatile platform of claim 12 wherein the first and second arcuate edge portions being oriented so as to form at the junction an interior angle, as determined by tangents to each of such edge portions, that is not less substantially than 90 degrees.

14. A platform according to claim 13, wherein the interior angle is approximately 180 degrees.

15. A versatile platform comprising:

(a) a top providing a substantially flat surface bounded (i) by each arcuate edge portion having a first and second end, the first ends of the first and second arcuate portions forming a junction first and second arcuate edge portions, being convex and concave respectively, the first and second arcuate edge portions being arcs of first and second circles respectively, the first and second circles-having radii that are approximately equal to a first length, 90 degrees and (ii) by a third substantially a third substantially straight edge portion joining the second ends of the first and second edge portions, the third substantially straight portion edge including a line segment of a line that approximates a tangent to the first and second circles;

(b) a base for supporting the top a predetermined distance above the ground;

so that the platform may be employed as one of a set of members similar to the platform, the members oriented so that the concave edge portion of one member mates with the convex edge portion of another adjacent member and the third edge portions of the members collectively define sides of a figure similar to a regular polygon having rounded corners, the rounded corners being formed by the convex edge portions.

16. The versatile platform of claim 15 wherein the first and second arcuate edge portions being oriented so as to form at the junction an interior angle, as determined by tangents to each of such edge portions, that is not less substantially than 90 degrees.

* * * * *

UNITED STATES PATENT AND TRADEMARK OFFICE

CERTIFICATE OF CORRECTION

PATENT NO. : 5,676,068
DATED : October 14, 1997
INVENTOR(S) : Charles A. Kallander It is certified that error appears in the above-identified patent and that said Letters Patent is hereby corrected as shown below:

Due to an error in printing claims 1 and 15 of the patent, based on the amendment filed April 29, 1997, please amend the claims as follows:

1. A versatile platform comprising:

(a) a top providing a substantially flat surface bounded (i) by first and second arcuate edge portions, being convex and concave respectively, each arcuate edge portion having a first and second end, the first ends of the first and second arcuate edge portions forming a junction, the first and second arcuate edge portions being arcs of first and second circles respectively, the first and second circles having radii of curvature that are approximately equal to a first length [and (ii) by] a third curved edge portion joining the second ends of the first and second edge portions, the third edge portion having an average radius of curvature that is substantially greater than the first length, the third edge portion including an arc from a third circle, the arcs of the first, second and third edge portions being so disposed that the third circle and the first circle approximately touch at a point where they have parallel tangents and the third circle and the second circle approximately touch at a point where they have parallel tangents;

(b) a base for supporting the top above the ground;

so that the platform may be employed as one of a set of members similar to the platform, the members oriented so that the concave edge portion of one member mates with the convex edge portion of another adjacent member and the members collectively define a common substantially continuous peripheral edge of the set of members so oriented.

15. A versatile platform comprising:

(a) a top providing a susbtantially flat surface bounded (i) by first and second arcuate edge portions, being convex and concave respectively, each arcuate edge portion having a first and second end, the first ends of the first and second arcuate portions forming a juction, the first and second arcuate edge portions being arcs of first and second circles respectively, the first and second circles having radii that are approximately equal to a first length [and] (ii) by a third susbtantially straight edge portion joining the second ends of the first and second edge portions, the third substantially straight portion edge including a line segment of a line that approximates a tangent to the first and second circles;

UNITED STATES PATENT AND TRADEMARK OFFICE

CERTIFICATE OF CORRECTION

PATENT NO. : 5,676,068
DATED : October 14, 1997
INVENTOR(S) : Charles A. Kallander It is certified that error appears in the above-identified patent and that said Letters Patent is hereby corrected as shown below:

(b) a base for supporting the top a predetermined distance above the ground; so that the platform may be employed as one of a set of members similar to the platform, the members oriented so that the concave edge portion of one member mates with the convex edge portion of another adjacent member and the third edge portions of the members collectively define sides of a figure similar to a regular polygon having rounded corners, the rounded corners being formed by the convex edge portions.

Signed and Sealed this

Seventh Day of August, 2001

*Attest:*

Nicholas P. Godici

*Attesting Officer*

NICHOLAS P. GODICI
*Acting Director of the United States Patent and Trademark Office*